United States Patent [19]

Blatter et al.

[11] Patent Number: 5,035,254

[45] Date of Patent: Jul. 30, 1991

[54] POWER TRANSMISSION

[75] Inventors: Albert Blatter, Highland; Robert E. Davis, Linden, both of Mich.

[73] Assignee: Vickers, Incorporated, Troy, Mich.

[21] Appl. No.: 497,394

[22] Filed: Mar. 22, 1990

[51] Int. Cl.[5] ..... F15B 13/043

[52] U.S. Cl. ..... 137/85; 137/82; 137/625.62; 335/230

[58] Field of Search ..... 137/82, 85, 625.62; 335/230

[56] References Cited

U.S. PATENT DOCUMENTS 3,023,782 3/1962 Chaves et al. ..... 137/85

3,323,090 5/1967 O'Brien ..... 137/625.62 X 3,517,359 6/1970 Trbovich et al. ..... 335/230

4,741,365 5/1988 Van Ornum ..... 137/625.65

*Primary Examiner*—Gerald A. Michalsky

*Attorney, Agent, or Firm*—Barnes, Kisselle, Raisch, Choate, Whittemore & Hulbert

[57] ABSTRACT

An electrohydraulic servovalve comprising a torque motor which receives an electrical signal and positions a flapper between a pair of opposed nozzles to control a spool valve and a feedback spring connected to the flapper and to the spool of the spool valve. The flapper is connected to an armature of the torque motor. The joint between the armature and the flapper comprises a one part, heat cured thermosetting adhesive.

8 Claims, 2 Drawing Sheets

POWER TRANSMISSION

This invention relates to electrohydraulic servovalves of the type comprising a torque motor and a spool valve.

BACKGROUND AND SUMMARY OF THE INVENTION

One common type of electrohydraulic servovalve comprises a first stage torque motor which receives an electrical signal and positions a flapper between a pair of opposed nozzles to control a spool valve and a feedback spring connected to the flapper and to the spool of the spool valve.

Such servovalves normally contain some means of converting an electric input signal to a mechanical output motion. In some designs, the mechanical output motion is very small and can be as small as 20 millionths of an inch. Since repeatability of better than 0.5% is required, it is apparent that the mechanical rigidity of the components which convert electrically generated forces to physical motion must be high. The means for converting the electrical input signal to a mechanical motion is through a device commonly called the torque motor. Application of current to the coils polarizes the armature which reacts with the field in the pole piece air gaps. This results in a moment on the armature and the armature/flapper assembly rotates around the virtual pivot point. Resisting the moment applied to the armature :s the force required to bend the spring tube as a cantilever beam and a pressure unbalance in the two nozzles facing the flapper. The generally accepted methods of attaching the armature to the flapper may be categorized as: clamping, soft soldering, hard soldering and press fitting.

All of these methods provide a metal to metal interface and the necessary rigidity, freedom from friction, stability and long life required by the armature/flapper joint. However, all of the above methods have manufacturing problems which result in added cost, loss of integrity or loss of mechanical or magnetic properties. The ideal attachment method would introduce no undesirable materials such as soldering flux, provide no mechanical stress on the armature to degrade the magnetic properties and not expose the armature/flapper/spring tube assembly to temperatures which may alter the mechanical or magnetic properties of the components.

Among the objectives of the present invention are to provide such a servovalve which overcomes the problems of the prior art; wherein the armature/flapper joint is stress free; wherein the armature and flapper are precisely positioned related to one another; which does not require the use of soldering flux and corrosive problems associated therewith; which has no creep movement under long term stress conditions; which can be readily made in commercial production; and which can be repeatedly and accurately provided in commercial production.

In accordance with the invention, the flapper is connected to the armature of the torque motor by a structural adhesive The joint between the armature and the flapper preferably comprises a one part, heat cured thermosetting structural adhesive.

DESCRIPTION

Figure 1:
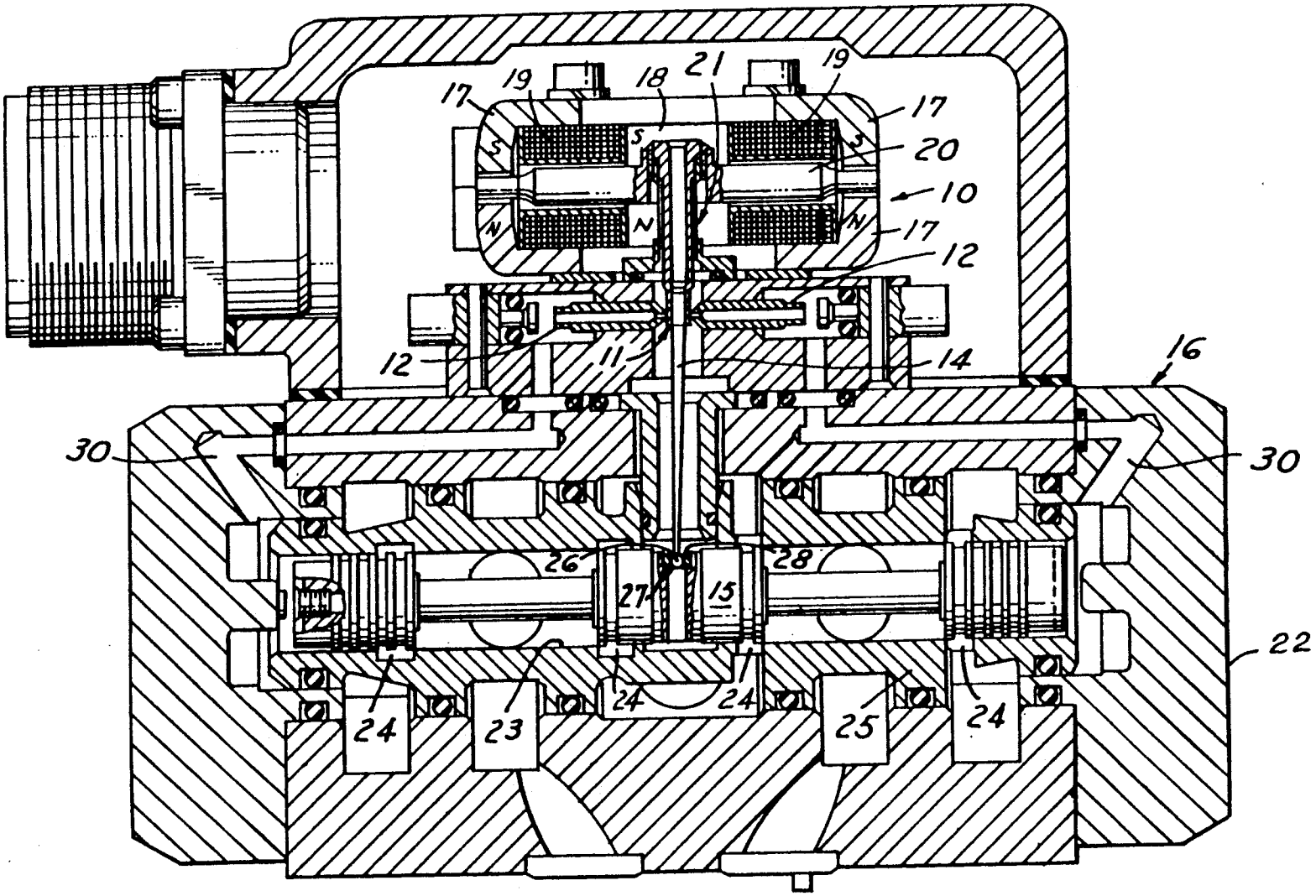
FIG. 1 is a cross sectional view of a servovalve embodying the invention.

Referring to FIG. 1, the invention relates to servovalves of the type comprising a first stage torque motor 10 which receives an electrical signal and positions a flapper 11 between a pair of opposed nozzles 12 to control a spool valve and includes a feedback spring 14 connected to the flapper 11 and to the spool 15 of a spool valve 16.

Specifically in such servovalves, the torque motor comprises a motor that includes pole pieces 17, permanent magnets 18, and coils 19 having openings therein. An elongated armature 20 is positioned with its ends projecting between the pole pieces. The flapper/armature subassembly is in the form of a spring tube 21 and is fixed in an opening in the armature 20 and projects transversely thereto. The flapper 11 is, in turn, fixed to the tube 21 and projects between two nozzles 12 in a nozzle block.

The torque motor is mounted on the housing 22 of a spool valve 16 which is shown as comprising a four-way closed center spool 15 sliding in a bore 23 and adapted to uncover openings 24, in a sleeve in the bore 23 to meter flow to control ports. Positioning of the spool 15 relative to the metering slots provides precision controlled flow. The feedback spring 14 is mounted on the flapper and includes a ball 26 that extends into an opening 27 in an insert 28 in the spool 15.

When an input signal is applied to the coils 19, the armature 20 ends are polarized creating a rotational torque on the armature 20. The tube 21 acts as a spring centering the flapper motion between the two nozzle openings 12. As the flapper 21 moves toward one nozzle or another, a pilot flow (pressure differential) is supplied which is applied through passages 30 to one end or the other of the spool 15 to position the spool 15. As the spool moves, the feedback spring 14 bends and applies a force to the flapper 21 which tends to recenter the flapper 21 between the nozzles 12. Positioning of spool occurs at the point in which the spring feedback force equals the torque motor force induced by the input current. The spool stops at this position and the flapper 21 is essentially centered until the input current changes to a different level. With constant supply pressure and flow of the servovalve, output control flow is infinitely proportional to the input current. Such construction is old and well known.

Figure 2:
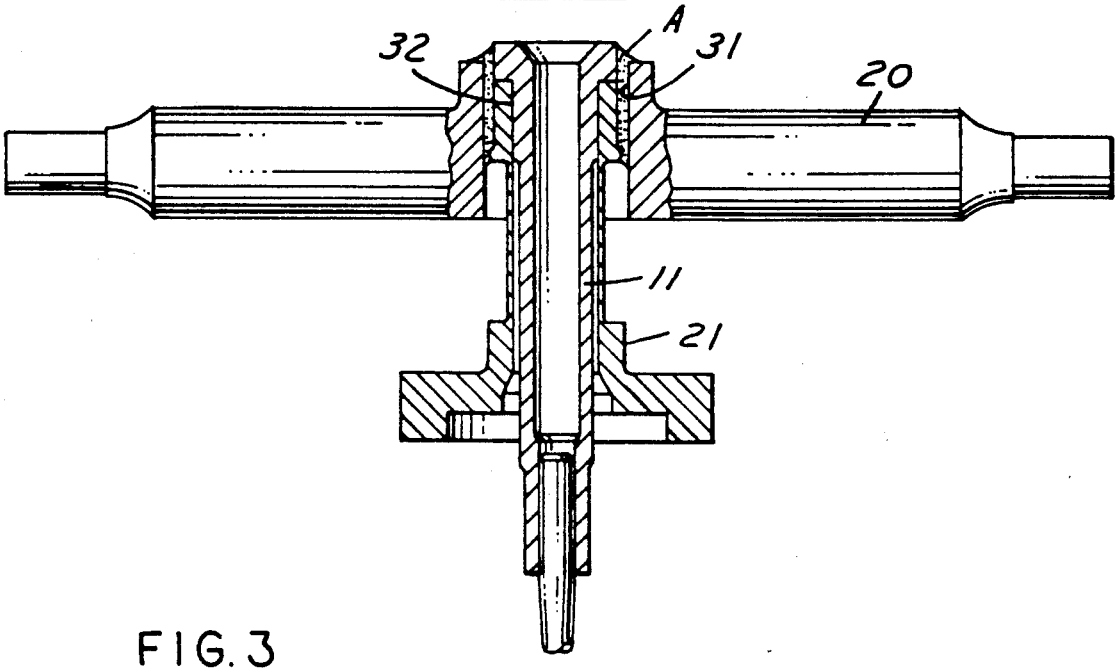
FIG. 2 is a fragmentary sectional view of a portion of the servovalve shown in FIG. 1 on an enlarged scale.

In accordance with the invention as shown in FIG. 2, the flapper is in the form of a tube 21 and is mounted in the armature opening by utilizing a one part, heat curing, thermosetting plastic adhesive A which is applied between the surfaces, namely, the inner surface 31 on the armature 20 and outer surface on the upper end of the flapper 21.

It has been found that a preferred composition that produces satisfactory results is a one part epoxy adhesive. Satisfactory results have been achieved by utilizing an adhesive made by 3M of St. Paul, Minn. and sold under the product specification 2214.

In a typical construction, the clearance between the tube and the armature opening is about 0.002 inches.

The adhesive may be applied by hand to the two surfaces and the surfaces brought together producing satisfactory results.

Figure 3:
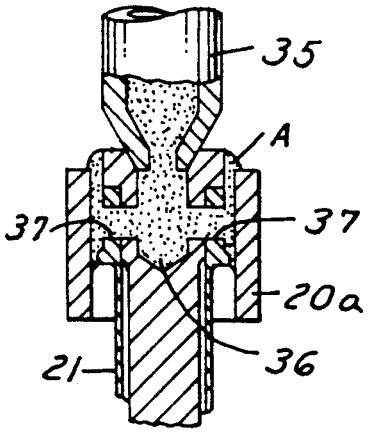
FIG. 3 is a sectional view showing one method forming the joint between the armature and flapper.

Alternatively, as shown in FIG. 3, the adhesive may be forced through an injection nozzle 35 axially into opening 36 of the spring tube 21 and through diametrically opposed radial openings 37 in the upper end of the spring tube 21 to the space between the tube 21 and the opening of the armature 20*a*.

Figure 4:
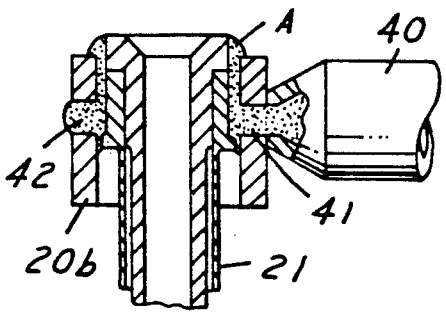
FIG. 4 is a sectional view showing another method of forming the joint between the armature and flapper.

In the form shown in FIG. 4, an injection nozzle 40 is brought adjacent to a radial opening 41 in the armature 20*b* and the adhesive A is forced into the space between tube 21 and armature 20*b* and permitted to extrude through an opposed radial opening 42 in the armature.

The adhesive, after being applied is cured at a temperature of 250° F.

It has been found that the above arrangement of torque motor armature/flapper subassembly produces the following advantages:

1. Solidifies in a stress free state and thereby leaves the armature/flapper subassembly exactly as fixtured.
2. Has a shear strength greater than the class of solders generically called "soft".
3. Permits use of wider tolerance bands on the mating parts for ease of assembly and cost reduction.
4. Does not require soldering flux (acid) which may attack the thin walled (0.0018) spring tube and which must be neutralized to prevent long term corrosion and failure of the tube.
5. Has no appreciable "creep" or movement under long term stressed conditions.
6. Cures at a low temperature (250° F.) which is within the normal operating temperature range of commercial torque motors.
7. Provides easily controlled filling of the joint by controlled volume injection.
8. By proper location of injection ports, all air or voids are eliminated in the joint for uniform joint quality.

It can thus be seen that there has been provided such a servovalve which overcomes the problems of the prior art; wherein the armature/flapper joint is stress free; wherein the armature and flapper are precisely positioned related to one another; which does not require the use of soldering flux and corrosive problems associated therewith; which has no creep movement under long term stress condition; which can be readily made in commercial production; and which can be repeatedly and accurately provided in commercial production.

What is claimed is:

1. In an electrohydraulic servovalve comprising a torque motor including flapper moved by an armature, a servovalve having a spool valve, said torque motor receiving an electrical signal and positioning the flapper between a pair of opposed nozzles to control the spool valve and a feedback spring tube connected to the flapper and to the spool of the spool valve, said electrohydraulic servovalve having a normal operating temperature range, the improvement comprising a one part heat curing thermosetting adhesive securing said spring tube in said armature, said thermosetting adhesive being of the type which is curable within the normal operating range of the electrohydraulic servovalve.

2. The servovalve set forth in claim 1 wherein said adhesive comprises an epoxy resin.

3. The servovalve set forth in claim 1 wherein said spring tube includes an axial opening and radial openings through which the adhesive extends.

4. The servovalve set forth in claim 1 wherein said armature includes radial openings through which said adhesive extends.

5. In a servovalve of the type an electrohydraulic servovalve comprising a torque motor which receives an electrical signal and positions a flapper mounted on an armature and extending between a pair of opposed nozzles to control a spool valve and a feedback spring tube connected to the flapper and to a spool of the spool valve, said electrohydraulic servovalve having a normal operating temperature range, the method of assembling the armature and spring tube which comprises applying a one part, heat curing thermosetting plastic adhesive having a curing temperature not greater than the operating temperature of the servovalve to the adjacent surfaces of an opening in the armature and an adjacent portion of the tube, thereafter assembling the armature and spring tube, and heat curing said thermosetting adhesive at a temperature not greater than the operating temperature of the servovalve.

6. The method set forth in claim 5 wherein said adhesive is applied by injecting the adhesive between the surfaces of the armature and spring tube.

7. The method set forth in claim 6 wherein said step of injecting comprises forming an axial opening and radial openings in the spring tube and injecting the adhesive axially into the spring tube and radially outwardly through said openings into the space between the spring tube and the armature eliminating voids in the adhesive.

8. The method set forth in claim 6 wherein said step of injecting the adhesive comprises forming radial openings in said armature and injecting the adhesive through one of the radial openings into the space between the spring tube and the armature and permitting the adhesive to extrude out of the other said openings eliminating voids in the adhesive.

* * * * *